US009777988B2

(12) United States Patent
Karcher

(10) Patent No.: US 9,777,988 B2
(45) Date of Patent: Oct. 3, 2017

(54) CONCEALED CARRY ANCHOR AND HOLSTER SYSTEM

(71) Applicant: Joseph Norman Karcher, Novi, MI (US)

(72) Inventor: Joseph Norman Karcher, Novi, MI (US)

(73) Assignee: Joseph N Karcher, Novi, MI (US)

( * ) Notice: Subject to any disclaimer, the term of this patent is extended or adjusted under 35 U.S.C. 154(b) by 9 days.

(21) Appl. No.: 15/003,631

(22) Filed: Jan. 21, 2016

(65) Prior Publication Data

US 2016/0209165 A1 Jul. 21, 2016

Related U.S. Application Data

(60) Provisional application No. 62/105,874, filed on Jan. 21, 2015.

(51) Int. Cl.
*F41C 33/00* (2006.01)
*F41C 33/04* (2006.01)
*F41C 33/02* (2006.01)

(52) U.S. Cl.
CPC ..... *F41C 33/048* (2013.01); *F41C 33/0254* (2013.01); *F41C 33/041* (2013.01)

(58) Field of Classification Search
CPC ..... A45F 5/02; A45F 5/021; F41C 33/048; F41C 33/041; F41C 33/0254; F41C 33/0263; F41C 33/0209
USPC ..... 224/587, 192, 193
See application file for complete search history.

(56) References Cited

U.S. PATENT DOCUMENTS 2,910,804 A * 11/1959 White ..... F41C 33/0263 2/300
6,296,164 B1 * 10/2001 Russo ..... A61F 5/449 224/581
9,581,413 B2 * 2/2017 Massaro, Jr. ..... F41C 33/04
2006/0032876 A1 * 2/2006 Goffinet ..... A45F 5/02 224/183
2013/0119098 A1 * 5/2013 Stiefel ..... A45F 5/02 224/183
2014/0224847 A1 * 8/2014 Miller ..... F41C 33/04 224/183
2015/0237998 A1 * 8/2015 Stevens, IV ..... A45F 5/021 224/660
2016/0061564 A1 * 3/2016 Gordon ..... F41C 33/041 224/587

* cited by examiner

*Primary Examiner* — Peter Helvey

(57) ABSTRACT

A concealed carry anchor and holster system secures a holster to a user in order to conceal a firearm from perception. The concealed carry anchor and holster system includes: a holster, to support the firearm; a garment portion, which is a portion of a garment the user wears in order to support and/or conceal the holster and subsequently a firearm; at least one anchor magnet and a holster magnet to secure the holster onto the garment portion. The holster magnet is integrated into the holster, while the at least one anchor is positioned adjacent to the garment portion. The garment portion is positioned between the at least one anchor magnet and the holster magnet. The at least one anchor magnet is magnetically engaged with the holster magnet in order to secure the holster to the garment portion. Therefore, a supported firearm is anchored to the user's body for efficient access.

17 Claims, 8 Drawing Sheets

CONCEALED CARRY ANCHOR AND HOLSTER SYSTEM

The current application claims a priority to the U.S. Provisional Patent application Ser. No. 62/105,874 filed on Jan. 21, 2015.

FIELD OF THE INVENTION

The present invention relates generally to holsters and weapon holding devices. In particular, the present invention relates to a multi-piece holster device that uses magnetic forces to allow for easy access, securement, and concealment of a firearm.

BACKGROUND OF THE INVENTION

Holsters are devices used to hold and/or restrict the unwanted movement of handguns or other firearms in a position that allows users to easily access the weapon for immediate use. A regular pocket holster and gun often fall to the bottom of a user's pocket and lean against the outside fabric of the pants, causing the outline or print of the gun to be noticed. Additionally, many pocket holsters have difficulty balancing the amount of friction necessary to properly hold the gun in place. If it has very little friction, it is common for a gun to move around in a pocket and partially or even fall out of the holster. These situations are unsafe as they could expose the trigger and possibly catch on something during basic or tactical movement. If there is too much friction, the gun and holster will tend to come out of the pocket together when drawing the gun. This may prove to be dangerous as individuals draw their gun in life or death situations.

It is therefore an objective of the present invention to introduce a concealed carry anchor and holster system. The present invention is an apparatus that is attached to a user's garment or strapped to the user's body in order to secure a weapon hidden from view. The present invention incorporates the use of magnets which secure a holster directly to another magnet or outside of a garment that has an integrated metallic portion.

While the present invention may be attached to just about any body part or garment, it is most common for it to be strapped to the user's leg. In these situations, the present invention is tight to the user's leg, and the holster will be attached to the anchor device when in the user's pocket. This will prevent the holster from pushing against the outside pants fabric, reducing an outline or print of the gun to be noticed. With the gun, holster, and anchor secured firmly in place, the present invention allows users to walk fast, run, jump, and even hang upside down without worrying about anything coming loose or disassembling. The present invention is not only safe, but comfortable to wear, as users complain that the weight of traditional pocket holsters restricts moving around during various activities.

DETAIL DESCRIPTIONS OF THE INVENTION

All illustrations of the drawings are for the purpose of describing selected versions of the present invention and are not intended to limit the scope of the present invention.

The present invention is a concealed carry anchor and holster system. The present invention is preferred to be positioned under or within a garment in order to conceal a firearm. The present invention allows for the complete concealment of a firearm from perception. The present invention is designed to reduce the print, or outline, of a firearm positioned under a garment of the user. The present invention secures a firearm firmly such that the user is able to walk swiftly, run, jump, and invert themselves without the firearm coming loose from the present invention or the present invention from disassembling.

Figure 1:
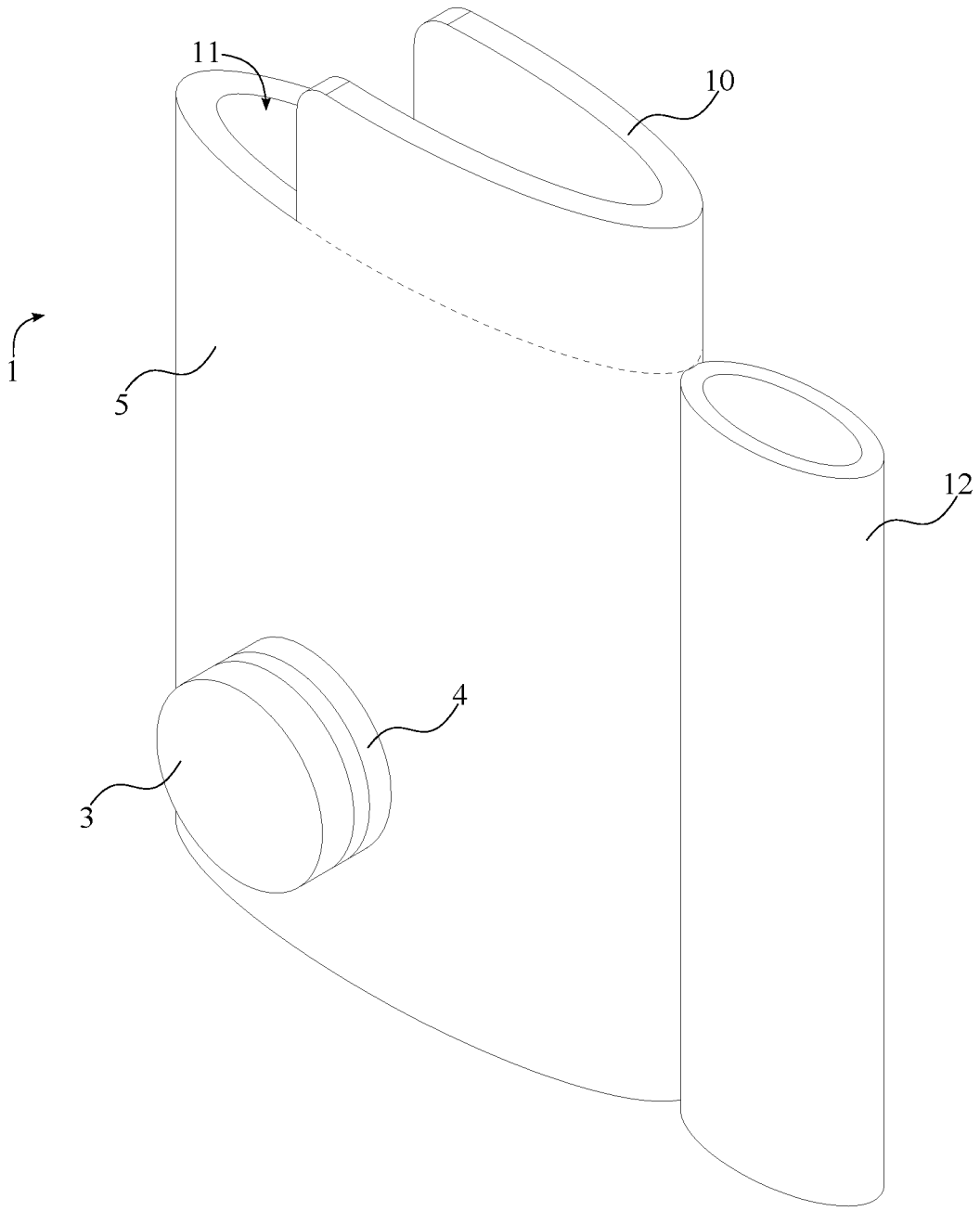
FIG. 1 is a perspective view of the holster, the holster magnet, at least one anchor magnet, the magazine holder, and the trigger guard of the present invention.
Figure 2:
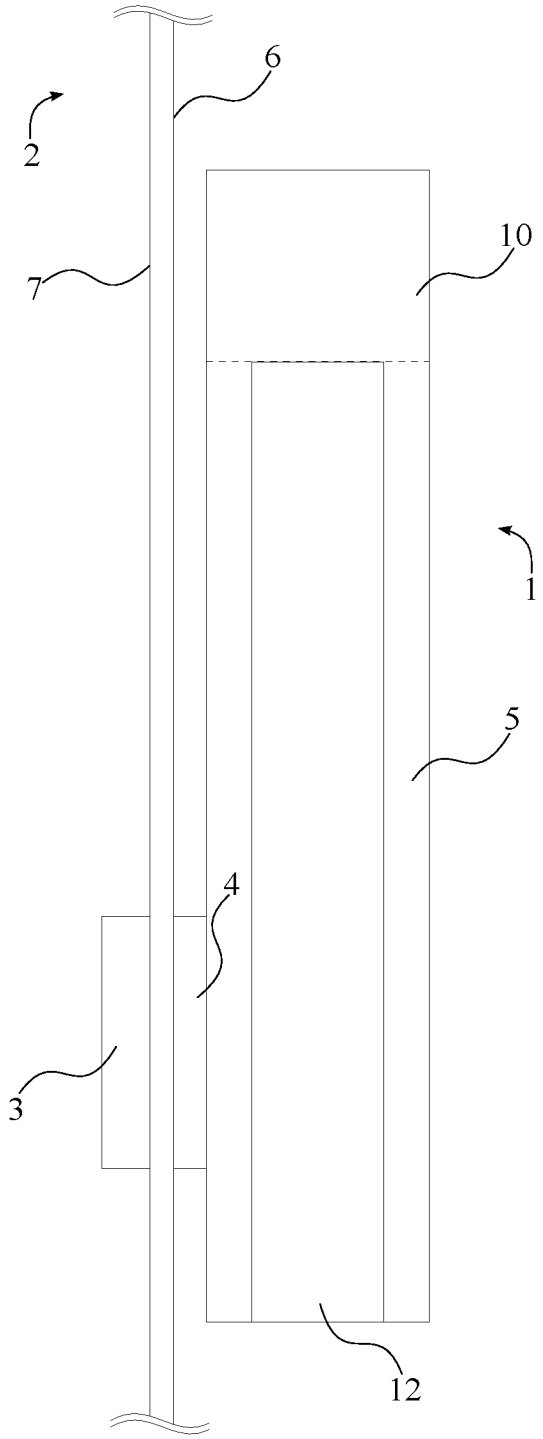
FIG. 2 is a side view of the present invention as the holster magnet engages the at least one anchor magnet through the garment portion, wherein the at least one anchor magnet is a single anchor magnet.
Figure 4:
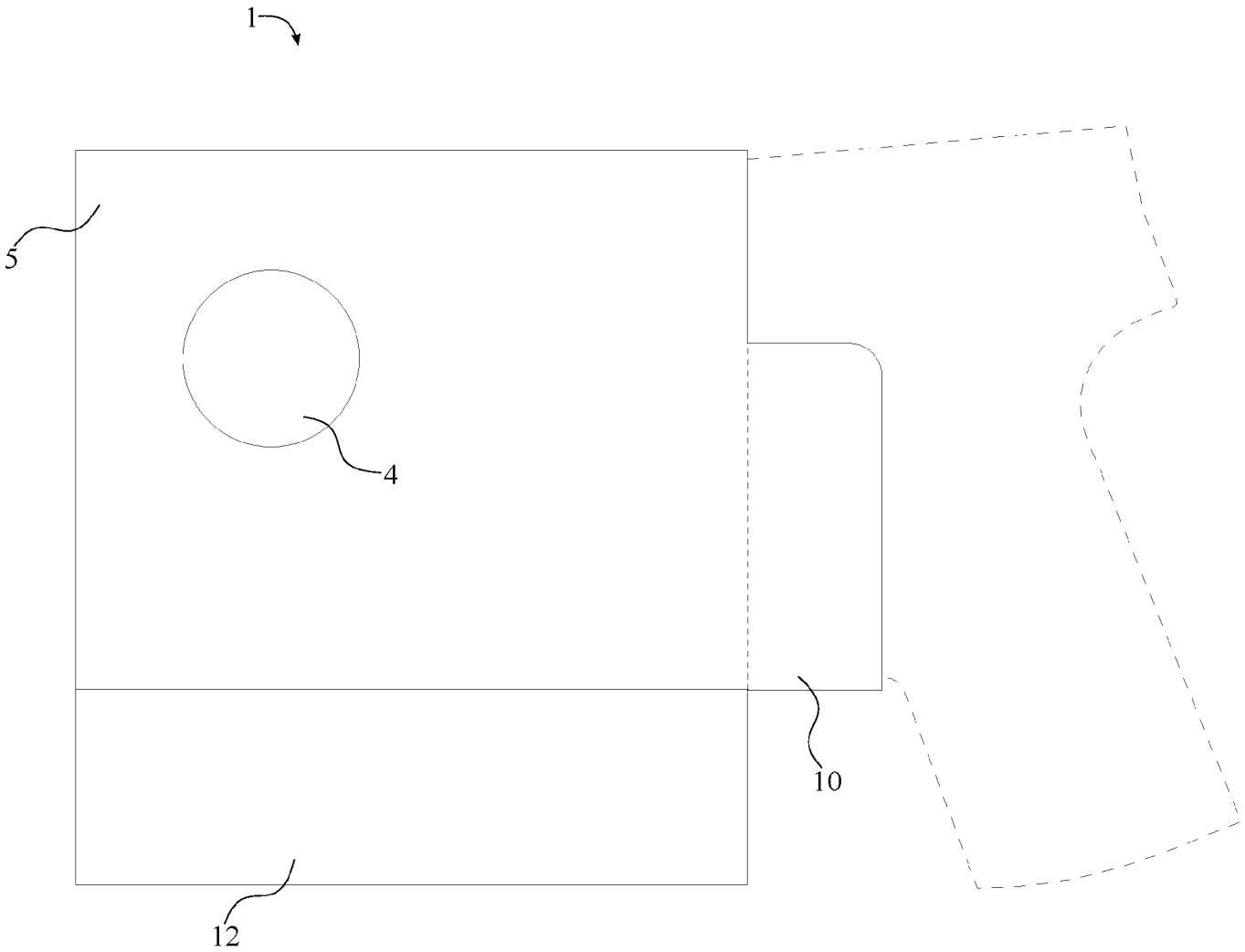
FIG. 4 is a rear view of the holster having a firearm inserted into the holster.

The present invention comprises a holster 1, a garment portion 2, at least one anchor magnet 3, and a holster magnet 4, in accordance to FIG. 2. The holster 1 allows for the positioning of a firearm for concealment, as well as, for efficient access the firearm for quick use. The holster 1 comprises a lateral portion 5 which prevents a firearm from rotating within the holster 1. The garment portion 2 supports the holster 1 and subsequently a firearm conveniently to a user's body. The at least one anchor magnet 3 and the holster magnet 4 secure the holster 1 to the garment portion 2. The holster magnet 4 further secures the firearm within the holster 1, as shown in FIG. 4. As a slide of a firearm is generally made from a metal which is affected by ferromagnetism, an attractive force between the slide and the holster magnet 4 secures the firearm within the holster 1. Similarly, the at least one anchor magnet 3 is magnetically engaged with the holster magnet 4. The firearm is able to be easily removed from the holster 1 as the attractive forces between the firearm and the holster magnet 4 are of a much smaller magnitude than that of the attractive forces between the holster magnet 4 and the at least one anchor magnet 3. In accordance to FIG. 1, the holster magnet 4 is integrated into the lateral portion 5 in order to mount a side of the holster 1 to the garment portion 2. The garment portion 2 comprises a first garment surface 6 and a second garment surface 7. The second garment surface 7 is opposite to the holster 1 about the first garment surface 6 for the positioning of the at least one anchor magnet 3 about the garment portion 2. The holster 1 is positioned adjacent to the first garment surface 6. The at least one magnet is positioned adjacent to the garment portion 2. The garment portion 2 is positioned between the at least one anchor magnet 3 and the holster magnet 4. Thus, the holster 1 is secured to the garment portion 2 by the magnetic attraction between the at least one anchor magnet 3 and the holster magnet 4, as shown in FIG. 2.

Figure 3:
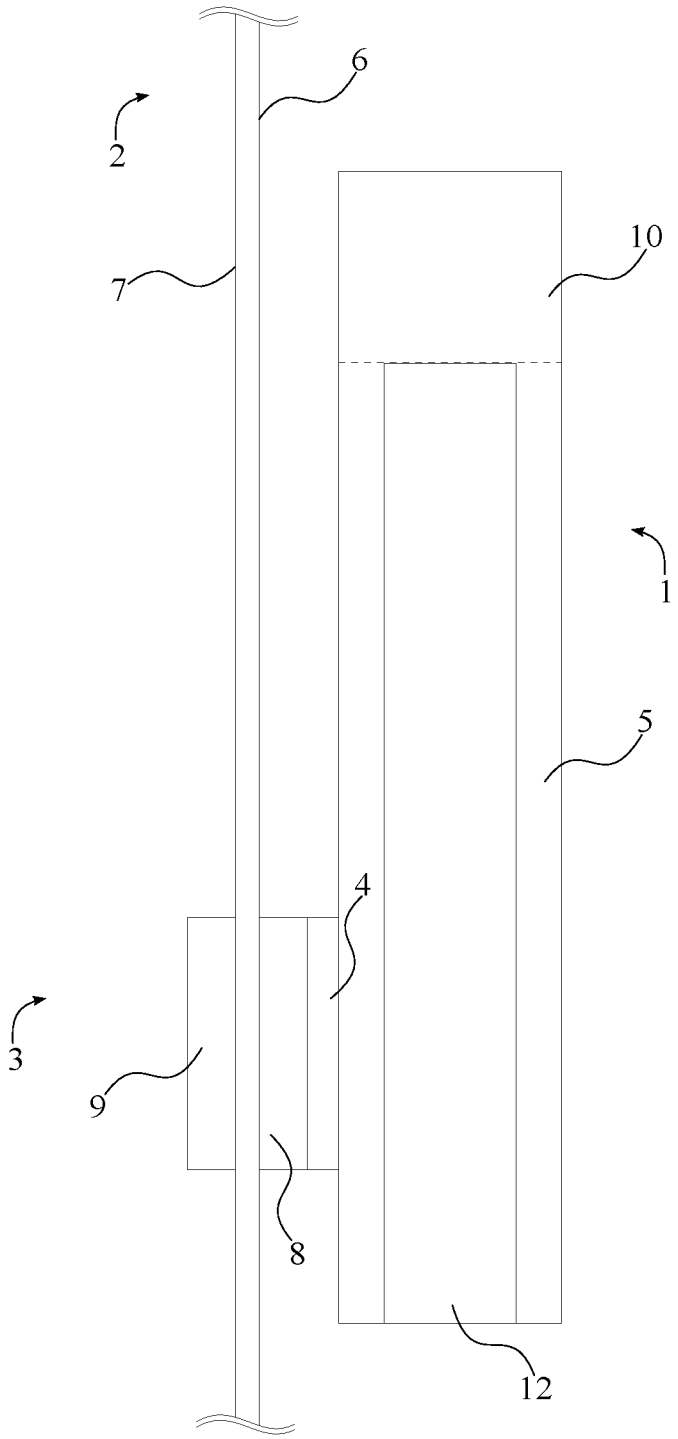
FIG. 3 is a side view of the present invention as the holster magnet engages the at least one anchor magnet through the garment portion, wherein the at least one anchor magnet is a first anchor magnet and a second anchor magnet.

In some embodiments of the present invention, the at least one anchor magnet 3 is a first anchor magnet 8 and a second anchor magnet 9, in accordance to FIG. 3. The first anchor magnet 8 is positioned adjacent to the first garment surface 6. The second anchor magnet 9 is positioned adjacent to the second garment surface 7, opposite to the first anchor magnet 8. The second anchor magnet 9 is magnetically engaged to the first anchor magnet 8. The first anchor magnet 8 is magnetically engaged to the holster magnet 4. This configuration secures the at least one anchor magnet 3 to the garment portion 2 while allowing the holster 1 to be removed from the at least one anchor magnet 3. The first anchor magnet 8 and the second anchor magnet 9 retain their position on the garment portion 2 as the holster 1 is removed, such that the holster 1 is able to be consistently placed in the same position in relation to the garment portion 2. The first anchor magnet 8 and the second anchor magnet 9 are preferred to have a greater magnetic strength than the holster magnet 4 such that the holster magnet 4 is able to be easily separated from second anchor magnet 9 while the first anchor magnet 8 and the second anchor magnet 9 remain magnetically bonded.

In accordance to the preferred embodiment of the present invention, the present invention comprises a trigger guard 10, as detailed in FIG. 1 to FIG. 4. The trigger guard 10 prevents the actuation of a trigger of the firearm as the user reaches for the firearm positioned in the holster 1. The holster 1 comprises a weapon insertion opening 11 which the firearm is positioned into in order to be supported by the holster 1. The trigger guard 10 is connected adjacent to the holster 1 about the weapon insertion opening 11. The trigger guard 10 extends away from the holster 1 to ensure the user cannot grasp the trigger as the user reaches for the firearm, preventing unintentional discharge of the firearm.

Further in accordance to the preferred embodiment of the present invention, the present invention comprises a magazine holder 12, shown in FIG. 1 to FIG. 4. The magazine holder 12 allows for the storage of an ammunition magazine or a tactical flashlight. The magazine holder 12 is preferred to be made of an elastic material in order to accommodate the storage for either an ammunition magazine or a tactical flashlight. The magazine holder 12 is connected adjacent and along the lateral portion 5. The magazine holder 12 is radially offset from the holster magnet 4 about the lateral portion 5, wherein the magazine holder 12 is positioned under a handle of the firearm as the firearm in positioned into the holster 1. The magazine holder 12 allows for a volume of a stored ammunition magazine or tactical flashlight to be positioned below the handle, thus reducing the print of the firearm by making the overall print generally rectangular. Having a generally rectangular print, the firearm is less likely to be perceived as a weapon as the firearm and the present invention would appear more like a wallet, phone, or similar shaped objects.

Figure 5:
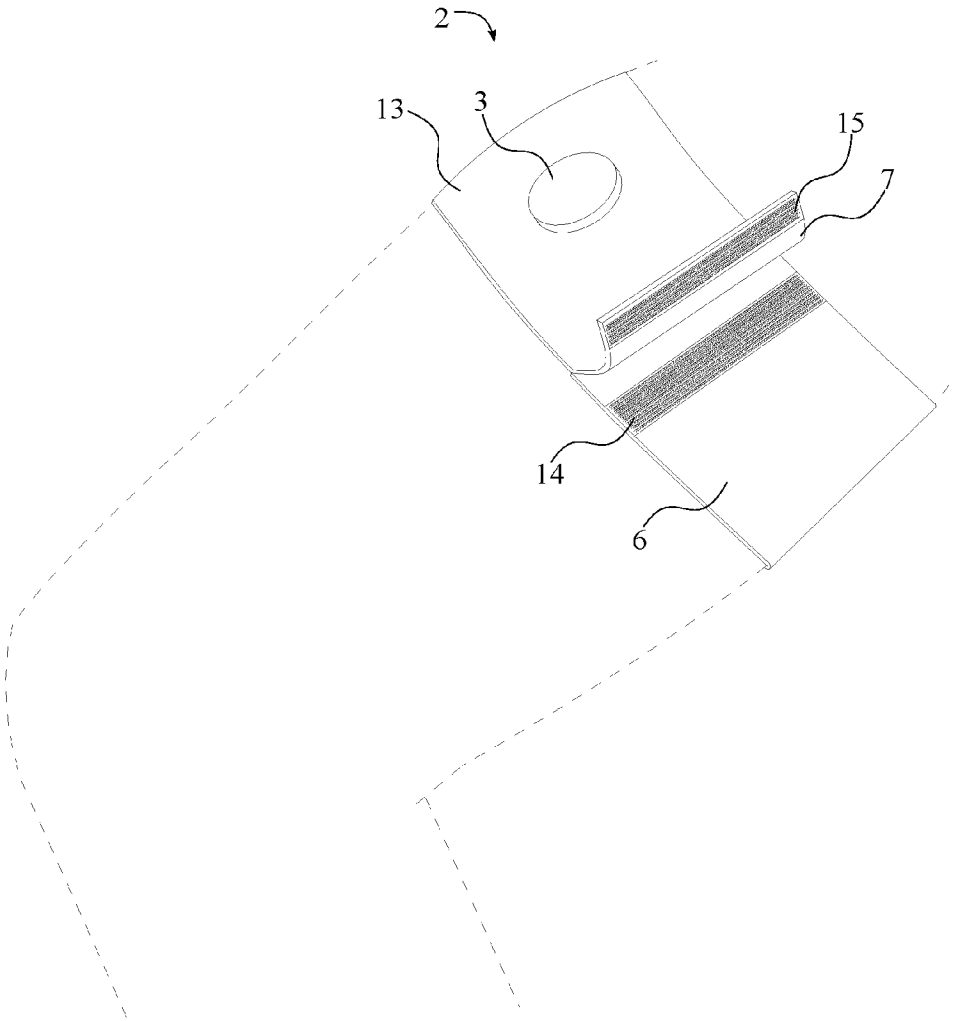
FIG. 5 is a perspective view of the garment portion of the present invention, wherein the garment portion is a leg strap.

In some embodiments of the present invention, the garment portion 2 is a leg strap 13, in accordance to FIG. 5. The leg strap 13 allows the present invention to be removably attached to the user's leg. The leg strap 13 comprises a first interlocking fastener 14 and a second interlocking fastener 15. The first interlocking fastener 14 and the second interlocking fastener 15 selectively engage each other in order to secure the leg strap 13 around a user's leg. The first interlocking fastener 14 and the second interlocking fastener 15 are preferred to be corresponding interlocking portions of a hook and loop fastener; however, the first interlocking fastener 14 and the second interlocking fastener 15 may be selected from snap-button fasteners, tie fasteners, or other appropriate fasteners to secure the leg strap 13 around the user's leg. The first interlocking fastener 14 is connected adjacent to the first garment surface 6. Similarly, the second interlocking fastener 15 is connected adjacent to the second garment surface 7. This configuration allows for the user to easily secure and remove the leg strap 13 from the user's leg. The second interlocking fastener 15 is preferred to be offset from the first interlocking fastener 14 along the leg strap 13, such that the first interlocking fastener 14 and the second interlocking fastener 15 engage each other as the leg strap 13 is placed about a user's leg. The at least one anchor magnet 3 is connected to the leg strap 13 between the first interlocking fastener 14 and the second interlocking fastener 15. Thus, the at least one anchor magnet 3 is able to be positioned, according to the comfort of the user, such that the holster 1, and subsequently the firearm, is easy to access and comfortably positioned against the user's leg.

Figure 6:
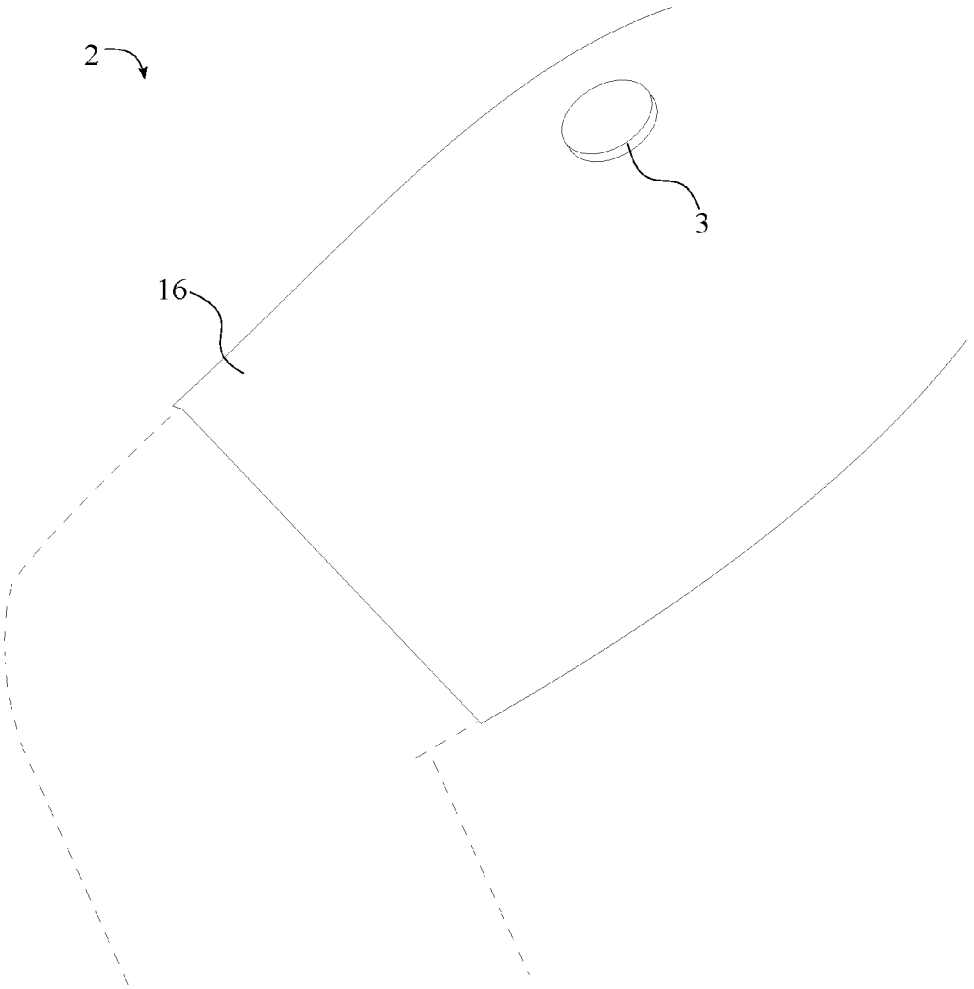
FIG. 6 is a perspective view of the garment portion of the present invention, wherein the garment portion is a boxer brief undergarment.

In some other embodiments of the present invention, the garment portion 2 is a leg portion of a boxer brief undergarment 16, where the boxer brief undergarment 16 includes, but is not limited to, boxer brief underwear, athletic compression shorts, or other similar garments. As shown in FIG. 6, the at least one anchor magnet 3 is integrated into the leg portion of a boxer brief undergarment 16. As the at least one anchor magnet 3 is fixed to the boxer brief undergarment 16, the holster magnet 4 is able to engage the at least one anchor magnet 3 despite the outer garment worn by the user.

Figure 7:
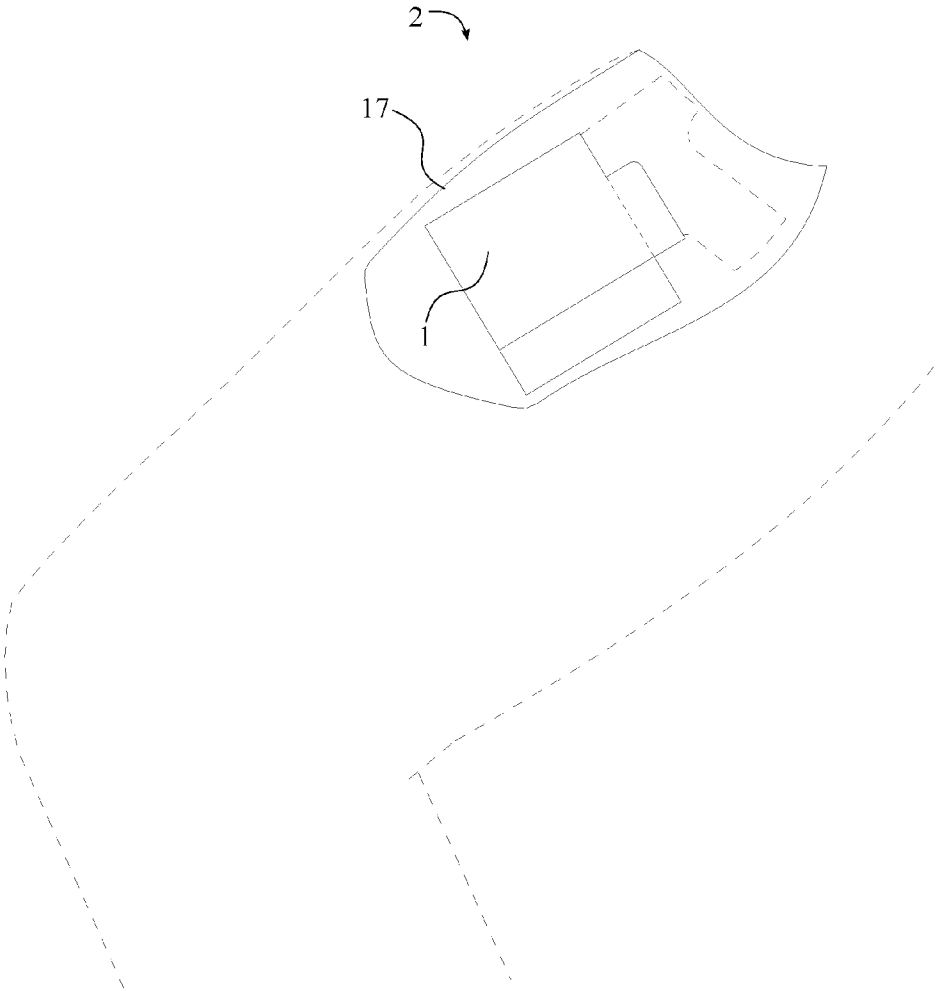
FIG. 7 is a perspective view of the garment portion of the present invention, wherein the garment portion is a pocket.
Figure 8:
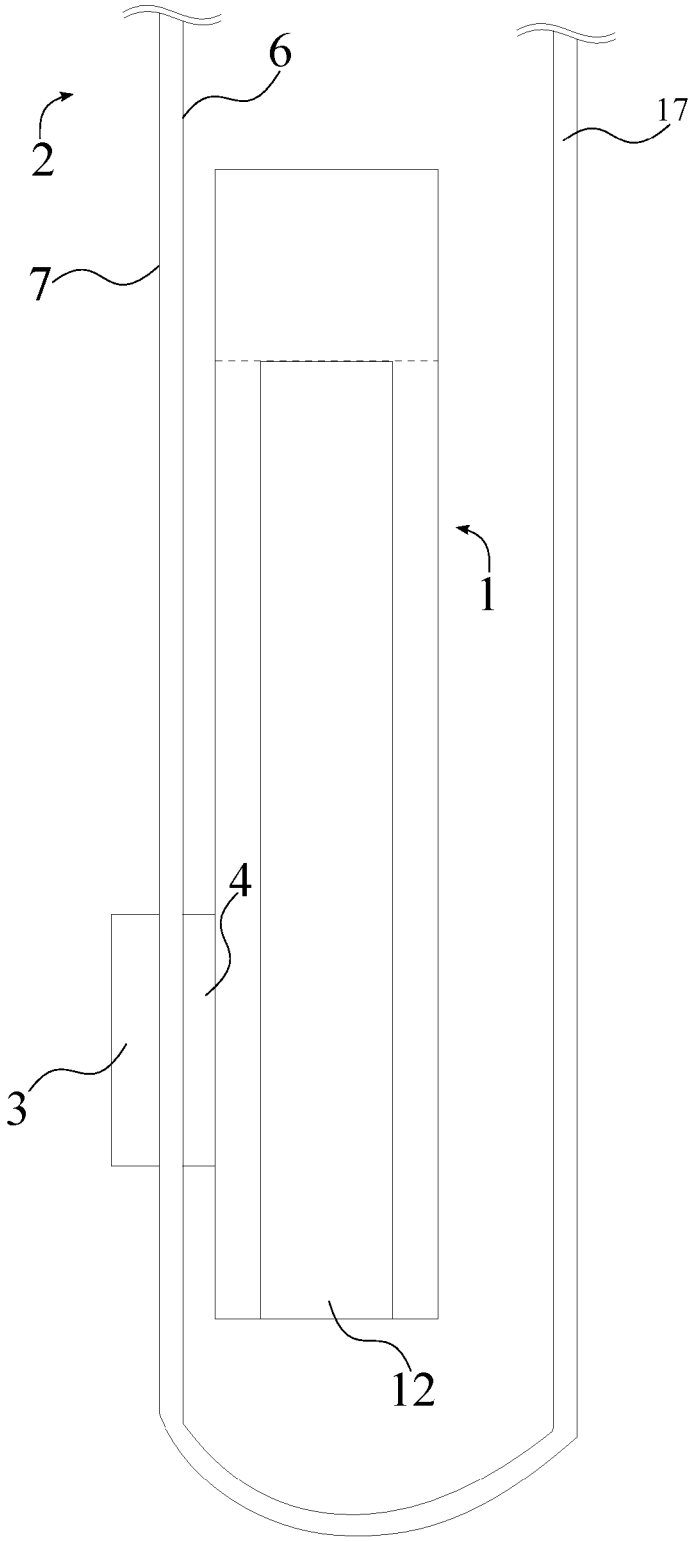
FIG. 8 is a side view of the present invention, wherein the holster is positioned within a pocket.

In accordance to the preferred embodiment, the garment portion 2 is a pocket 17, as shown in FIG. 7 and FIG. 8. The pocket 17 allows for the holster 1 to be concealed as the holster 1 is internally positioned within the pocket 17. The at least one anchor magnet 3 is positioned adjacent to the second garment surface 7 opposite to the holster 1. The holster 1 is positioned internally within the pocket 17, adjacent to the second garment surface 7, such that the holster magnet 4 magnetically engages the at least one anchor magnet 3 through the pocket 17. Therefore, the holster 1 is secured within the pocket 17. The at least one anchor magnet 3 and the holster magnet 4 fix the holster 1 to the pocket 17 such that as the user pulls the firearm from the holster 1, the holster 1 remains attached to the pocket 17 even when the pocket 17 is pulled through the garment, which the pocket 17 is integrated. Additionally in embodiments of the present invention comprising a magazine holder 12, the magazine holder 12 reduces the rotation of the holster 1 within the pocket 17 by providing additional volume through an attached ammunition magazine, thus limiting the space which the present invention and a supported firearm can rotate within the pocket 17.

Although the invention has been explained in relation to its preferred embodiment, it is to be understood that many other possible modifications and variations can be made without departing from the spirit and scope of the invention as hereinafter claimed.

What is claimed is:

1. A concealed carry anchor and holster system comprises:

a holster;

a garment portion;

at least one anchor magnet;

a holster magnet;

the holster comprises a lateral portion;

the garment portion comprises a first garment surface and a second garment surface;

the holster magnet being integrated into the lateral portion;

the holster being positioned adjacent to the first garment surface;

the second garment surface being opposite to the holster about the first garment surface;

the at least one anchor magnet being positioned adjacent to the garment portion;

the garment portion being positioned between the at least one anchor magnet and the holster magnet; and the at least one anchor magnet being magnetically engaged with the holster magnet.

2. The concealed carry anchor and holster system, as claimed in claim 1, comprises:

the at least one anchor magnet being a first anchor magnet and a second anchor magnet;

the first anchor magnet being positioned adjacent to the first garment surface;

the second anchor magnet being positioned adjacent to the second garment surface, opposite to the first anchor magnet;

the second anchor magnet being magnetically engaged to the first anchor magnet; and the first anchor magnet being magnetically engaged to the holster magnet.

3. The concealed carry anchor and holster system, as claimed in claim 2, wherein the first anchor magnet and the second anchor magnet have a greater magnetic strength than the holster magnet.

4. The concealed carry anchor and holster system, as claimed in claim 1, comprises:

a trigger guard;

the holster comprises a weapon insertion opening; and the trigger guard being connected adjacent to holster about the weapon insertion opening.

5. The concealed carry anchor and holster system, as claimed in claim 1, comprises:

a magazine holder;

the magazine holder being connected adjacent and along the lateral portion; and the magazine holder being radially offset from the holster magnet about the lateral portion.

6. The concealed carry anchor and holster system, as claimed in claim 1, comprises:

the garment portion being a leg strap;

the leg strap comprises a first interlocking fastener and a second interlocking fastener;

the first interlocking fastener being connected adjacent to the first garment surface;

the second interlocking fastener being connected adjacent to the second garment surface; and the first interlocking fastener and the second interlocking fastener being selectively engaged to each other.

7. The concealed carry anchor and holster system, as claimed in claim 6, comprises:

the second interlocking fastener being offset from the first interlocking fastener along the leg strap; and the at least one anchor magnet being connected to the leg strap between the first interlocking fastener and the second interlocking fastener.

8. The concealed carry anchor and holster system, as claimed in claim 1, comprises:

the garment portion being a leg portion of a boxer brief undergarment.

9. The concealed carry anchor and holster system, as claimed in claim 1, comprises:

the garment portion being a pocket; and the holster being positioned within the pocket.

10. A concealed carry anchor and holster system comprises:

a holster;

a garment portion;

at least one anchor magnet;

a holster magnet;

a trigger guard;

the holster comprises a lateral portion and a weapon insertion opening;

the garment portion comprises a first garment surface and a second garment surface;

the holster magnet being integrated into the lateral portion;

the holster being positioned adjacent to the first garment surface;

the second garment surface being opposite to the holster about the first garment surface;

the at least one anchor magnet being positioned adjacent to the garment portion;

the garment portion being positioned between the at least one anchor magnet and the holster magnet;

the at least one anchor magnet being magnetically engaged with the holster magnet; and the trigger guard being connected adjacent to holster about the weapon insertion opening.

11. The concealed carry anchor and holster system, as claimed in claim 10, comprises:

the at least one anchor magnet being a first anchor magnet and a second anchor magnet;

the first anchor magnet being positioned adjacent to the first garment surface;

the second anchor magnet being positioned adjacent to the second garment surface, opposite to the first anchor magnet;

the second anchor magnet being magnetically engaged to the first anchor magnet; and the first anchor magnet being magnetically engaged to the holster magnet.

12. The concealed carry anchor and holster system, as claimed in claim 2, wherein the first anchor magnet and the second anchor magnet have a greater magnetic strength than the holster magnet.

13. The concealed carry anchor and holster system, as claimed in claim 10, comprises:

a magazine holder;

the magazine holder being connected adjacent and along the lateral portion; and the magazine holder being radially offset from the holster magnet about the lateral portion.

14. The concealed carry anchor and holster system, as claimed in claim 10, comprises:

the garment portion being a leg strap;

the leg strap comprises a first interlocking fastener and a second interlocking fastener;

the first interlocking fastener being connected adjacent to the first garment surface;

the second interlocking fastener being connected adjacent to the second garment surface; and the first interlocking fastener and the second interlocking fastener being selectively engaged to each other.

15. The concealed carry anchor and holster system, as claimed in claim 14, comprises:

the second interlocking fastener being offset from the first interlocking fastener along the leg strap; and the at least one anchor magnet being connected to the leg strap between the first interlocking fastener and the second interlocking fastener.

16. The concealed carry anchor and holster system, as claimed in claim 10, comprises:

the garment portion being a leg portion of a boxer brief undergarment.

17. The concealed carry anchor and holster system, as claimed in claim 10, comprises:

the garment portion being a pocket; and the holster being positioned within the pocket.

* * * * *